US007585064B2

(12) United States Patent
Lim et al.

(10) Patent No.: US 7,585,064 B2
(45) Date of Patent: Sep. 8, 2009

(54) APPARATUS TO REMOVE BUBBLES IN AN INKJET PRINTER

(75) Inventors: Su-min Lim, Seongnam-si (KR); Sung-wook Kang, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 519 days.

(21) Appl. No.: 11/583,832

(22) Filed: Oct. 20, 2006

(65) Prior Publication Data

US 2007/0120912 A1 May 31, 2007

(30) Foreign Application Priority Data

Nov. 30, 2005 (KR) ..... 10-2005-0115845

(51) Int. Cl.
*B41J 2/19* (2006.01)
*B41J 2/18* (2006.01)

(52) U.S. Cl. ..... 347/92; 347/89

(58) Field of Classification Search ..... 347/35, 347/84, 85, 89, 92; 417/392, 395
See application file for complete search history.

(56) References Cited

U.S. PATENT DOCUMENTS 5,561,448 A * 10/1996 Kaneko et al. ..... 347/29
5,730,538 A * 3/1998 Kato ..... 400/702.1
6,231,174 B1 * 5/2001 Haigo ..... 347/89

FOREIGN PATENT DOCUMENTS

| | | |
|---|---|---|
| JP | 57-8371 | 1/1982 |
| JP | 07-17061 | 1/1995 |
| JP | 08-118680 | 5/1996 |
| JP | 2004-299098 | 10/2004 |

* cited by examiner

*Primary Examiner*—Anh T. N. Vo
(74) *Attorney, Agent, or Firm*—Stanzione & Kim LLP

(57) ABSTRACT

An image forming apparatus includes a bubble removing apparatus to remove bubbles from a channel and a chip of a printhead by applying a pressure to an ink circulation line using a pumping unit. The pumping unit includes a housing, a vibration unit to generate pressure variations to move ink from the intake to the outlet including a circulation cam to circulate ink contained in the channel of the printhead along the ink circulation line and a purging cam to vibrate the vibration unit to discharge the ink contained in the chip of the printhead through a nozzle, and a clutch unit to transmit power from the motor to the circulation cam or the purging cam in a selective manner.

15 Claims, 8 Drawing Sheets

APPARATUS TO REMOVE BUBBLES IN AN INKJET PRINTER

CROSS-REFERENCE TO RELATED APPLICATIONS

This application claims the benefit of Korean Patent Application No. 10-2005-0115845, filed on Nov. 30, 2005, in the Korean Intellectual Property Office, the disclosure of which is incorporated herein in its entirety by reference.

BACKGROUND OF THE INVENTION

1. Field of the Invention

The present general inventive concept relates to an apparatus to remove bubbles from a printhead of an inkjet printer, and more particularly, to a bubble removing apparatus usable with a line printing type array printhead.

2. Description of the Related Art

Generally, an inkjet printer is a device that prints a desired image by ejecting droplets of ink onto paper. FIGS. 1 and 2 illustrate a conventional inkjet printer. Referring to FIG. 1, the conventional inkjet printer includes a printhead 10 ejecting ink droplets through nozzles 11*a*, feed rollers 20 feeding paper (P) below the printhead 10, and ejecting rollers 30 ejecting the paper (P) to a tray 40 after printing. When the feed rollers 20 feed the paper (P) below the printhead 10, the printhead 10 ejects the ink droplets through nozzles 11*a* formed in a chip 11 to print the desired image, and the ejecting rollers 30 eject the paper (P) to the tray 40 after printing.

Examples of the printhead 10 include a shuttle type printhead and a line printing type printhead. The shuttle type print head prints each lateral line of the desired image while reciprocating in a width direction of paper (P). The line printing type printhead has a width corresponding to the width of paper (P), such that the line printing type printhead can simultaneously print one line of an image at a fixed position. The line printing type printhead is also referred to as an array type printhead, is preferred over the shuttle type print head because the array type printhead provides a high speed printing characteristic.

In the conventional inkjet printer, the ink droplets are ejected through the nozzles 11*a* formed in the chip 11 of the printhead 10. Therefore, if the nozzles 11*a* are clogged by bubbles, the ink droplets are not properly ejected, and thus the desired image is not properly formed. To solve this problem, various conventional methods are used to remove the bubbles from ink. In a representative method of the various conventional approaches, a suction cap is put on the chip 11 of the printhead 10, and the nozzles 11*a* are sucked using a pump to remove the bubbles from the nozzles 11*a* together with a little amount of the ink. Although this method can be effectively used for the shuttle type printhead having a small number of the chips 11 and a small size, it is difficult to use this method for the array type printhead since the chips 11 of the array type printhead are widely arranged across the width of the paper (P). That is, since the array type printhead includes a plurality of the chips 11 with the nozzles 11*a* arranged in the width direction of the paper (P) to entirely cover the width of the paper (P), it is difficult to precisely put caps on all the chips 11 for a hermetic or airtight seal. Further, it is difficult to apply a uniform pressure to the nozzles 11*a* to suck the bubbles from the nozzles 11*a*. To solve these problems, another method illustrated in FIG. 2 is used to remove the bubbles from the array type printhead. Referring to FIG. 2, an ink circulation line 60 is provided between the printhead 10 and an ink tank 50, and if necessary, ink is circulated between the printhead 10 and the ink tank 50 using a diaphragm pump 70. That is, when the ink reaches the ink tank 50 during circulation, the bubbles are removed from the ink due to a specific gravity difference between the bubbles and the ink.

Although the bubbles can be removed from a channel of the printhead 10 using the ink circulation method of FIG. 2, that is, although the bubbles can be removed from the ink before the ink flows into the chips 11 of the printhead 10, the bubbles cannot be removed from the ink that has already entered the chips 11 of the printhead 10 since the ink that has entered the chips 11 is not circulated through the ink circulation line 60. The bubbles are removed from the ink that has entered the chips 11 through purging. In a purge process, a valve 80 of the ink circulation line 60 is closed, and the diaphragm pump 70 is intensively operated two or three times to apply a large pressure to the printhead 10, such that the bubbles can be pushed out of the chips 11 of the printhead 10 together with a little amount of the ink. That is, both the circulation and purging must be performed to remove the bubbles from the ink in the array type printhead 10.

However, the conventional inkjet printer requires two motors, a circulation motor (M1) 71 and a purging motor (M2) 72, in the diaphragm pump 70 to perform the circulation and purging since the circulation and purging requires different operating conditions. FIGS. 3A and 3B are characteristic graphs respectively illustrating a pump output in the circulation process for removing the bubbles and a pump output in the purge process for removing bubbles for the conventional bubble removing apparatus. During the circulation process, the diaphragm pump 70 is slowly operated to continuously generate a pressure of about 2 kpa as illustrated in FIG. 3A. However, during the purging process, the diaphragm pump 70 is operated one or two times to generate an instantaneous pressure larger than 7 kpa, as illustrated in FIG. 3B. For this reason, the two motors 71 and 72 with different output powers are used.

However, because of the two motors and power transmitting structures for connecting the two motors to the diaphragm pumps, the inkjet print has a complicated structure and a heavy weight. Therefore, there is a need for an apparatus that has a more simplified structure and can smoothly perform the circulation and purging processes.

SUMMARY OF THE INVENTION

The present general inventive concept provides a bubble removing apparatus usable in an inkjet printer that performs circulation and purging operations using a single motor.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing a bubble removing apparatus usable in an inkjet printer, including an ink circulation line to connect an ink tank and a printhead, and a pumping unit to apply a pressure to the ink circulation line to remove bubbles from a channel and a chip of the printhead, wherein the pumping unit includes a housing including an inlet and an outlet that are connected to the ink circulation line, a vibration unit installed to the housing and capable of vibrating, the vibration unit to generate pressure variations to move ink from the intake to the outlet, a motor to drive the vibration unit, a circulation cam to vibrate the vibration unit while rotated by the motor in a circulation mode, to circulate the ink contained in the channel of the printhead along the ink circulation line, a purging cam installed coaxially with the circulation cam, the purging cam to vibrate the vibration unit while rotated by the motor in a purge mode, to discharge the ink contained in the chip of the printhead through a nozzle, and a clutch unit to transmit power of the motor to one of the circulation cam and the purging cam in a selective manner.

The circulation cam may include a cam surface to cause the vibration unit to vibrate in a gentle manner, and the purging cam may include a cam surface to cause the vibration unit to vibrate in an abrupt manner.

The clutch unit may include a first ratchet wheel having a first tooth orientation to engage a first ratchet surface formed on the circulation cam to transmit a driving force in one direction, a second ratchet wheel having a second tooth orientation opposite to the first tooth orientation of the first ratchet wheel, to engage a second ratchet surface formed on the purging cam to transmit the driving force in a direction opposite to the one direction, a first elastic member to apply a first elastic force in a first direction to allow the first ratchet wheel to engage the ratchet surface of the circulation cam, and a second elastic member to apply an elastic force in a second direction to allow the second ratchet wheel to engage the ratchet surface of the purging cam.

The first ratchet wheel, the second ratchet wheel, the circulation cam, and the purging cam may be coaxially installed on a driving shaft.

The vibration unit may include a piston installed to the housing and capable of reciprocating, the piston being vibrated according to the cam surface of the rotating circulation cam or the cam surface of the rotating purging cam, and an elastic diaphragm to repeatedly deform and return to its original shape to interlock with the piston to generate pressure variations in the housing to suck the ink through the intake and to discharge the ink through the outlet.

The foregoing and/or other aspects and utilities of the present general inventive concept may also be achieved by providing an apparatus to remove bubbles in an inkjet printer, including a housing having an inlet, an outlet, and a vibration unit connected between the inlet and the outlet, a circulation cam having a first shape to control the vibration unit in a circulation mode, a purging cam having a second shape to control the vibration unit to move ink between the inlet and the outlet in a purging mode, and a single motor to selectively control one of the circulating cam and the purging cam.

The foregoing and/or other aspects and utilities of the present general inventive concept may also be achieved by providing an inkjet printer, including feed rollers to feed the printing medium to the inkjet printhead, ejecting rollers to remove the printing medium after an image has been formed thereon, an inkjet printhead to form images on a printing medium, an ink tank to supply ink to the inkjet printhead, and a pump to circulate the ink from the ink tank to the inkjet printhead, the pump including a housing having an inlet, an outlet, and a vibration unit connected between the inlet and the outlet, a circulation cam having a first shape to control the vibration unit in a circulation mode, a purging cam having a second shape to control the vibration unit to move ink between the inlet and the outlet in a purging mode, and a single motor to selectively control one of the circulating cam and the purging cam.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
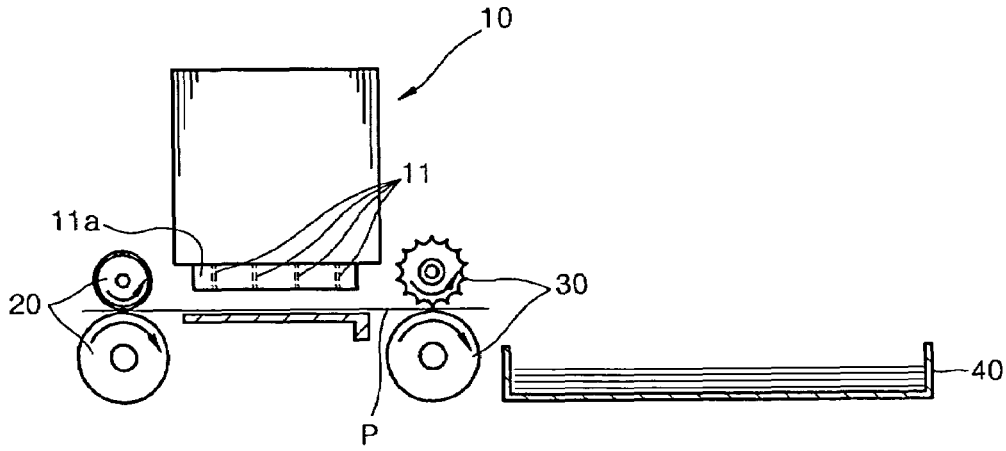
FIG. 1 (PRIOR ART)
FIG. 1 illustrates a structure of a conventional inkjet printer.
Figure 2:
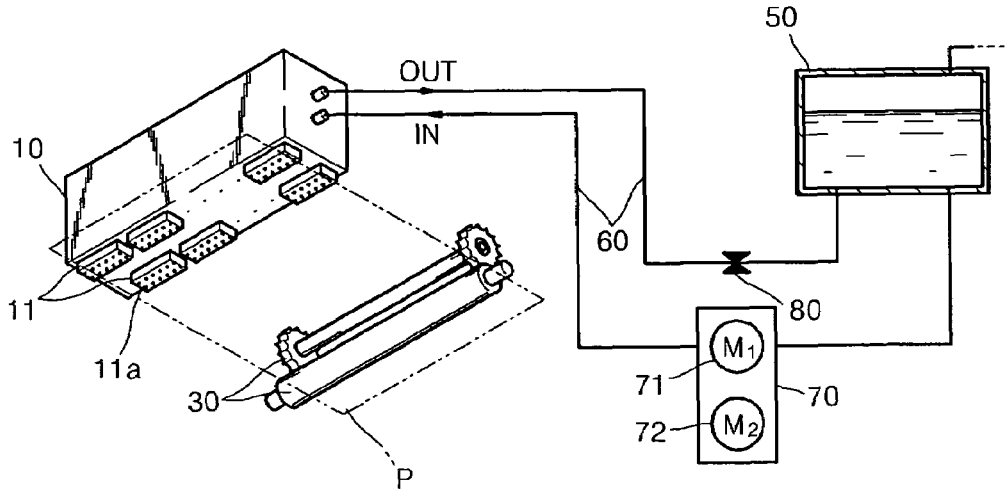
FIG. 2 (PRIOR ART)
FIG. 2 illustrates a schematic structure of a conventional bubble removing apparatus.
Figure 3A:
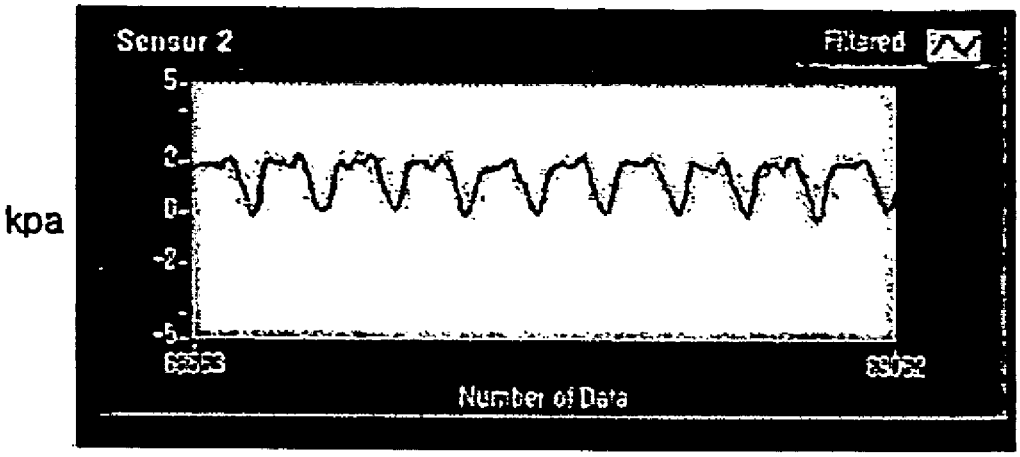
FIG. 3A (PRIOR ART)
FIGS. 3A and 3B are characteristic graphs respectively illustrating a pump output in a circulation process for removing bubbles and a pump output in a purge process for removing bubbles of a conventional bubble removing apparatus.
Figure 3B:
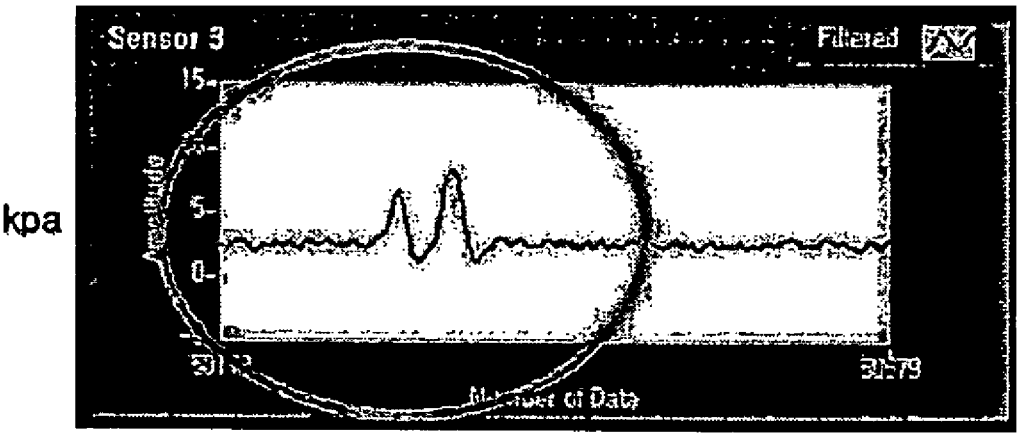
FIG. 3B (PRIOR ART)

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 4:
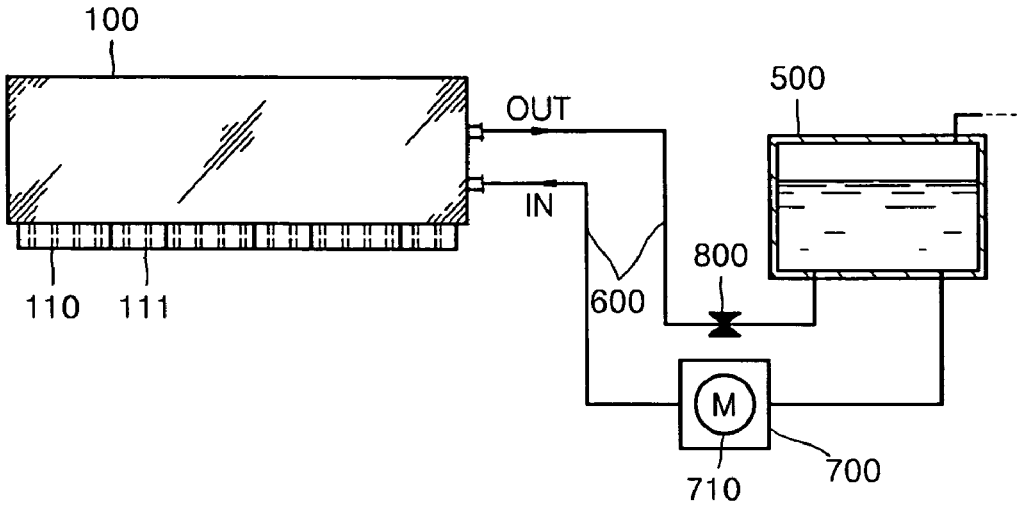
FIG. 4 is a view illustrating a bubble removing apparatus according to an embodiment of the present general inventive concept.

FIG. 4 is a view illustrating a bubble removing apparatus according to an embodiment of the present general inventive concept.

Referring to FIG. 4, the bubble removing apparatus includes an ink circulation line 600 to connect a printhead 100 and an ink tank 500, and a pumping unit 700 to circulate ink. When the pumping unit 700 operates in an open state of a valve 800, a circulation mode starts. In the circulation mode, the ink is moved from a channel (not shown) of the printhead 100 to the ink tank 500 through the ink circulation line 600 and the valve 800 and returned to the channel from the ink tank 500 through the ink circulation line 600 and the pumping unit 700. During the circulation mode, bubbles contained in the ink are separated from the ink in the ink tank 500 owing to a specific gravity difference therebetween to thereby remove the bubbles from the ink in the printhead 100. In a purge mode, the valve 800 is closed, and a large pressure is instantaneously applied from the pumping unit 700 through the ink circulation line 600 to remove the bubbles from the ink contained in chips 110 of the printhead 100 by discharging the bubbles to an outside through nozzles 111.

Figure 5:
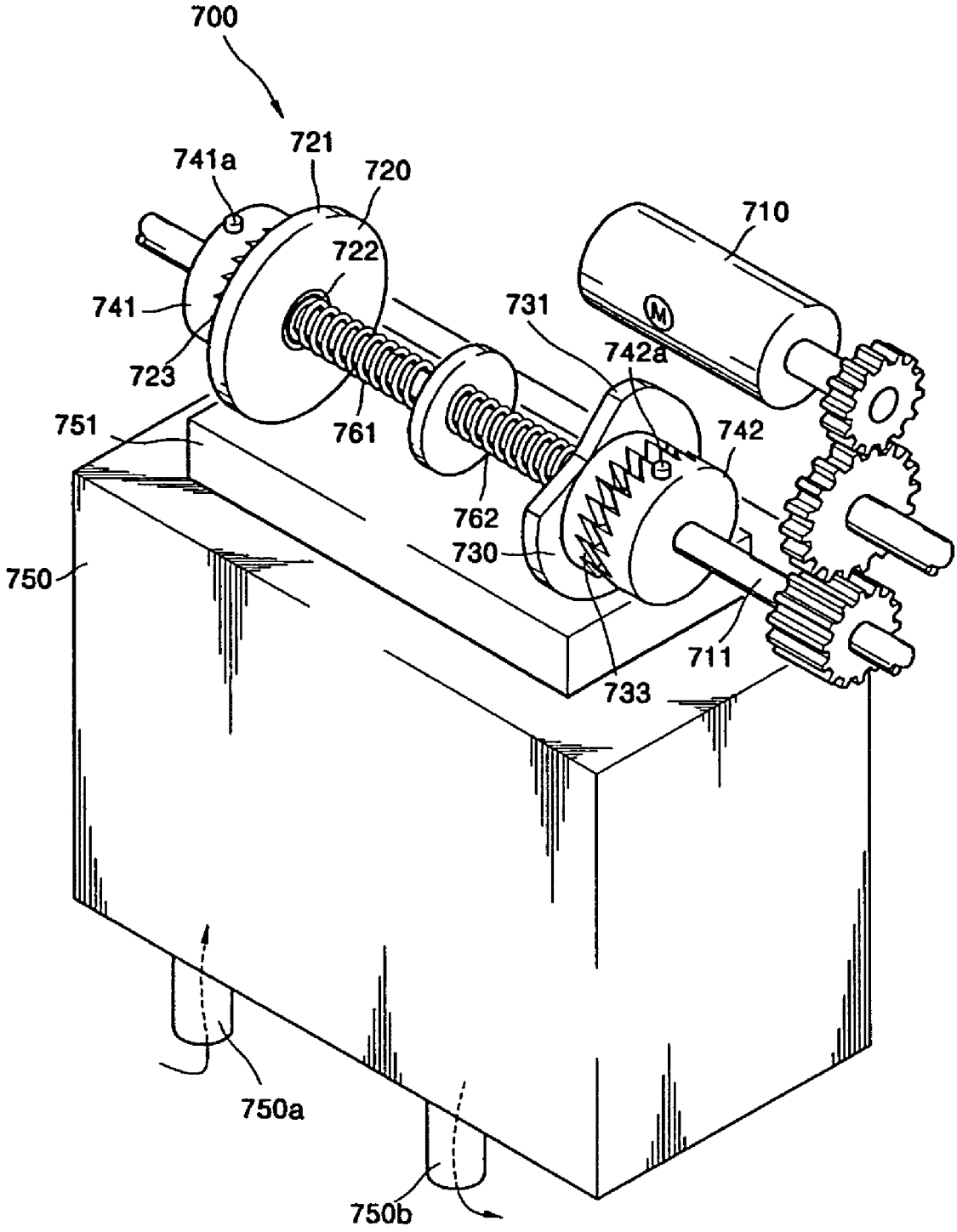
FIGS. 5 and 6 are views illustrating a pump unit of the bubble removing apparatus of FIG. 4.
Figure 6:
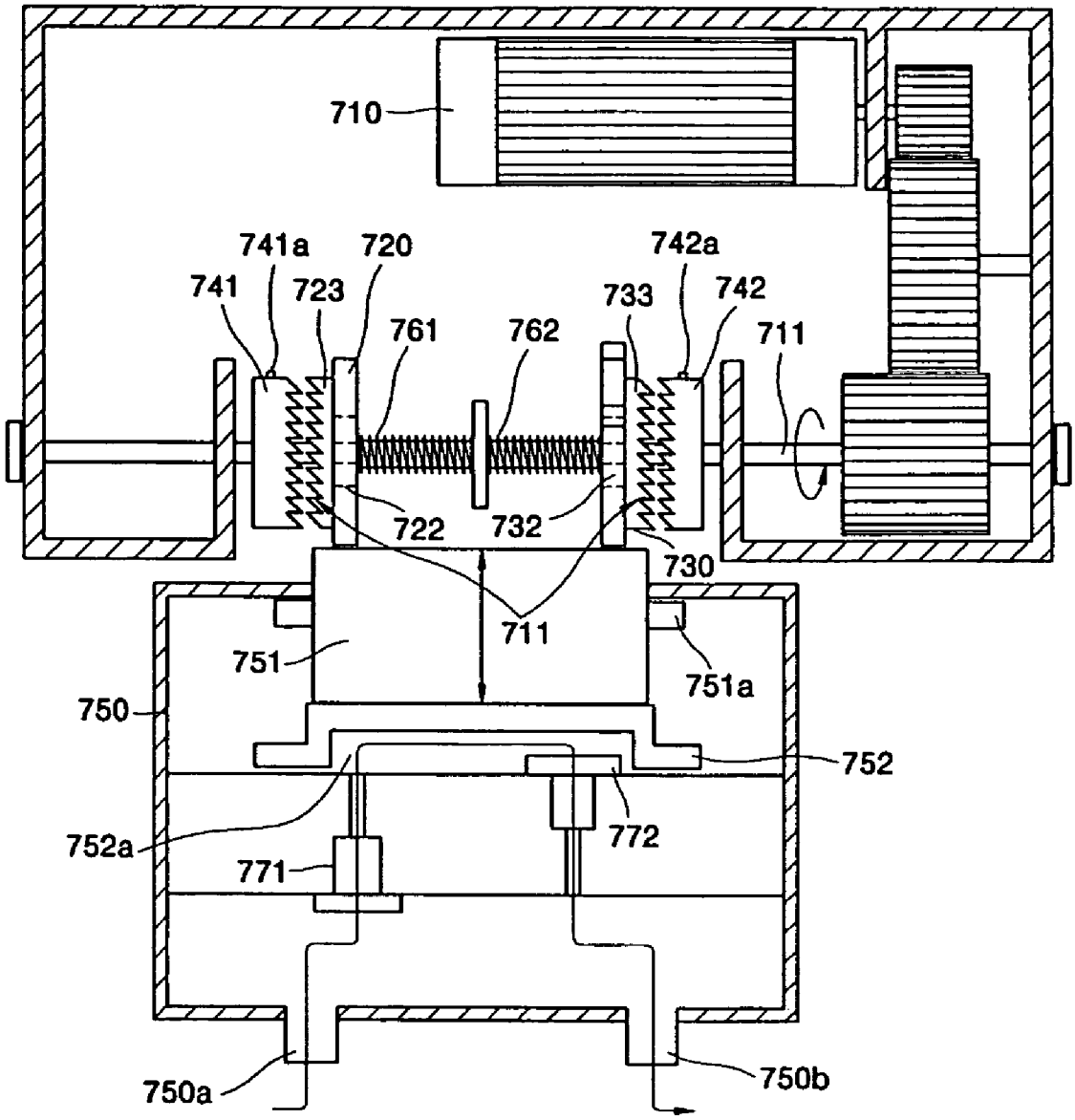
Figure 7A:
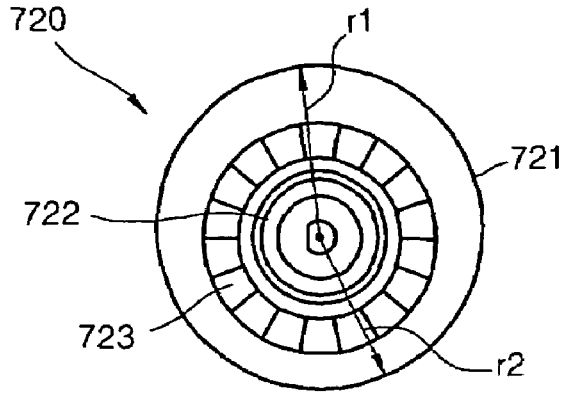
FIGS. 7A through 7C are views illustrating a circulation cam and a purging cam of the pump unit of FIG. 5.
Figure 7B:
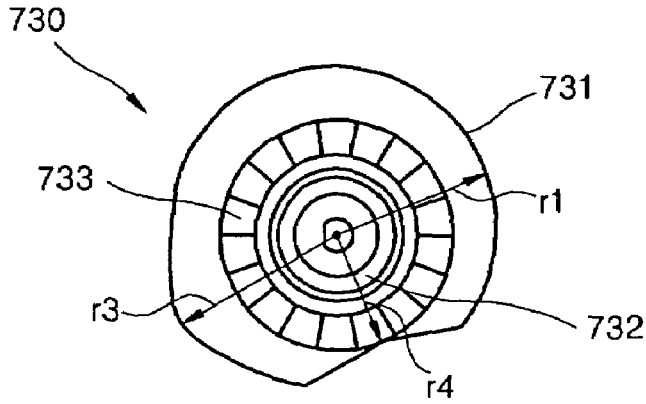
Figure 7C:
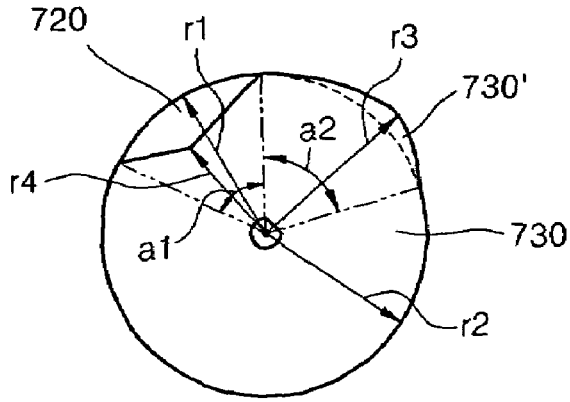

FIGS. 5 and 6 are views illustrating the pumping unit 700 of the bubble removing apparatus of FIG. 4. Referring to FIGS. 4-6, the pumping unit 700 is configured to perform the circulation and purge modes using a single motor (M) 710. FIGS. 5 and 6 are views illustrating a pump unit of the bubble removing apparatus of FIG. 4. FIGS. 7A through 7C illustrate a circulation cam 720 and a purging cam 730 of the pump unit 700 of FIG. 4. Referring to FIGS. 5 and 6, the pumping unit 700 includes the motor 710, the circulation cam 720, and the purging cam 730 that are installed on a driving shaft 711 connected with the motor 710 to receive driving power from the motor 710. The circulation cam 720 has a circular shape with an axis of rotation displaced from a center thereof. That is, the radius of the circulation cam 720 is eccentric so that one side extends further than other sides thereof, In addition, the circulation cam has a gently profiled cam surface 721 as illustrated in FIG. 7A. The purging cam 730 has a steeply profiled cam surface 731 with a cutout as illustrated in FIG. 7B. When the two cams 720 and 730 are overlapped as illustrated FIG. 7C, a portion 730' of the purging cam 730 is protruded from the profile of the circulation cam 720, such that a stroke of a piston 751 is changed by the rotation of the purging cam 730 more than by the rotation of the circulation cam 720.

The circulation and purging cams 720 and 730 have different shapes to cause different pressure changes in the ink depending on which of the circulation or purging cam 720 and 730 contacts the piston 751. The gently profiled surface 721 of the circulation cam 720 may have a first radius r1 that is greatest for the circulation cam 720 and a second radius r2 that is smallest for the circulation cam 720. The purging cam 730 may also have a portion of its radius be equal to the first radius r1 of the circulation cam 720. The purging cam 730 may have a third radius r3 that is a radius for the protruded portion 730' that is greater than the first radius of the circulation cam 720 and a fourth radius r4 for the cutout that is smaller than any of the first, second, and third radii r1, r2, and r3. When the circulation and purging cams 720 and 730 are overlapped as illustrated in FIG. 7C, the profile thereof demonstrates that the third radius r3 is greatest, the first radius r1 is larger than the second radius r2, and that the fourth radius r4 is smallest. In addition, an angle a2 formed by a width of the protruding portion 730' of the purging cam 730 is smaller than an angle a1 formed by a width of the cam surface 721 of the circulation cam. Thus, a vibration caused by the circulation cam 720 builds steadily while a vibration caused by the purging cam 730 builds quickly. In addition, the purging cam 730 causes a greater pressure to be formed within the pumping unit 700.

The piston 751 is installed on a housing 750 to elastically reciprocate in a motion determined by the cam surfaces 721 and 731 having different shapes. By the reciprocating motion of the piston 751, an elastic diaphragm 752 that is installed under the piston 751 is repeatedly deformed and returned to its original shape. Through the reciprocating motion, the piston 751 and the elastic diaphragm 752 make up a vibration unit to generate pressure variations to suck and discharge the ink. The pressure inside the housing 750 varies according to a vibration of the vibration unit, such that the ink can be sucked into a pressure generating space 752*a* through an intake 750*a* and a first check valve 771 and pushed to the outside through a second check valve 772 and an outlet 750*b*.

In the circulation mode, the circulation cam 720 is rotated to vibrate the piston 751 of the vibration unit, and in the purging mode, the purging cam 730 is rotated to vibrate the piston 751. A clutch unit is provided to transmit the power of the motor 710 to one of the circulation cam 720 and the purging cam 730 in a selective manner as described above. The clutch unit includes a first ratchet wheel 741 and a second ratchet wheel 742, and a first spring 761 and a second spring 762. The first and second ratchet wheels 741 and 742 are installed on the driving shaft 711 to couple with respective ratchet surfaces 723 and 733 formed on the circulation cam 720 and the purging cam 730. The first and second springs 761 and 762 provide elastic forces to couple the ratchet wheels 741 and 742 and the ratchet surfaces 723 and 733, respectively. The first and second springs 761 and 762 ensure contact between the respective first and second ratchet wheels 741 and 742 and the ratchet surfaces 723 and 733. The rotation direction of the circulation cam 720 when coupled with the first ratchet wheel 741 is different from the rotation direction of the purging cam 730 when coupled with the second ratchet wheel 742. That is, ratchet engagement directions of the ratchet surfaces 723 and 733 are opposite to each other. For example, when the driving shaft 711 is rotated counterclockwise, the circulation cam 720 is rotated by the engagement with the first ratchet wheel 741, and when the driving shaft 711 is rotated clockwise, the purging cam 730 is rotated by the engagement with the second ratchet wheel 742.

The first and second ratchet wheels 741 and 742 are fixed to the driving shaft 711 using pins 741*a* and 742*a*, such that the first and second ratchet wheels 741 and 742 always rotate with the driving shaft 711. However, the circulation cam 720 and the purging cam 730 are rotatably coupled to the driving shaft 711 using bearings 722 and 733, and may be slightly movable in an axis direction of the driving shaft 711. That is, when the elastic forces from the first and second spring 761 and 762 are received by the circulation cam 720 and the purging cam 730, the respective circulation and purging cams 720 and 730 are moved along the axis of the driving shaft 711 to be selectively engaged. Therefore, the circulation cam 720 and the purging cam 730 can be rotated with the driving shaft 711 when the driving power of the motor 710 is transmitted thereto by the coupling between the ratchet surfaces 723 and 733 and the first and the second ratchet wheels 741 and 742. Otherwise, only inner rims of the bearings 722 and 732 are rotated together with the driving shaft 711, and the circulation cam 720 and the purging cam 730 coupled to outer rims of the bearings 722 and 732 are not rotated.

An operation of the above-described bubble removing apparatus will now be described.

Figure 8A:
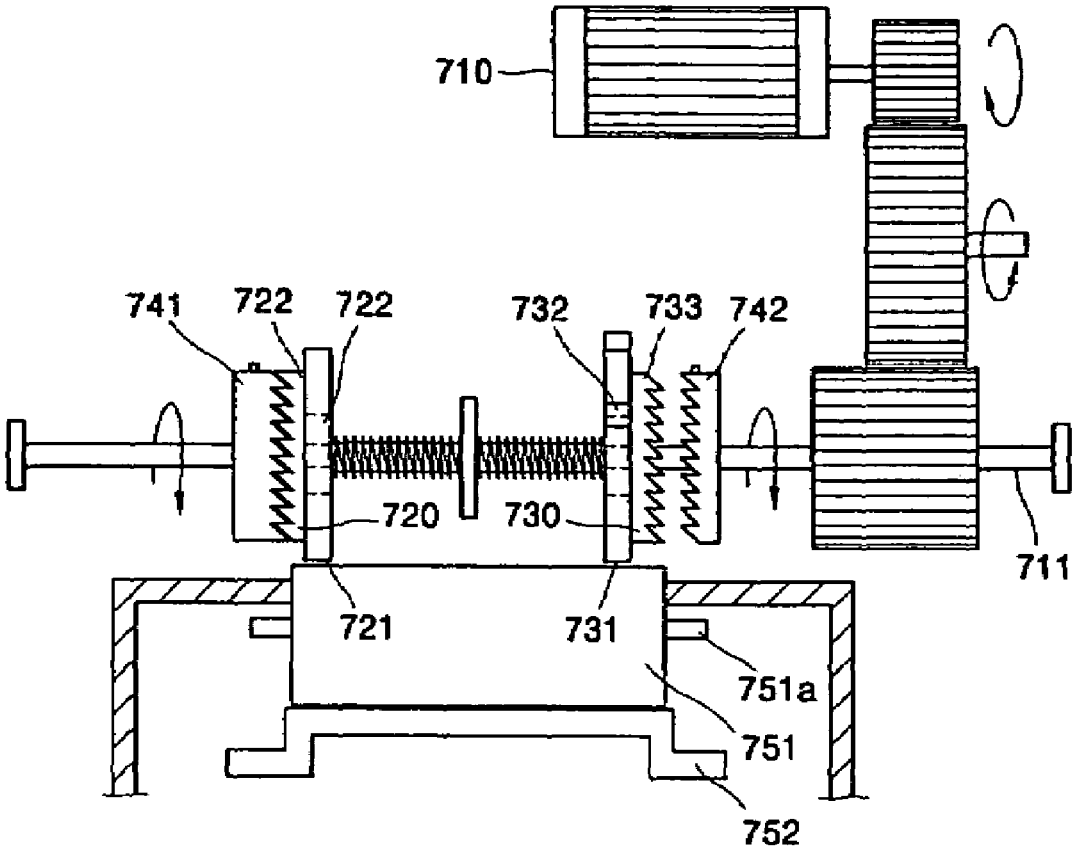
FIGS. 8A and 8B are views illustrating an operation of the pump unit of FIGS. 4 and 5.
Figure 8B:
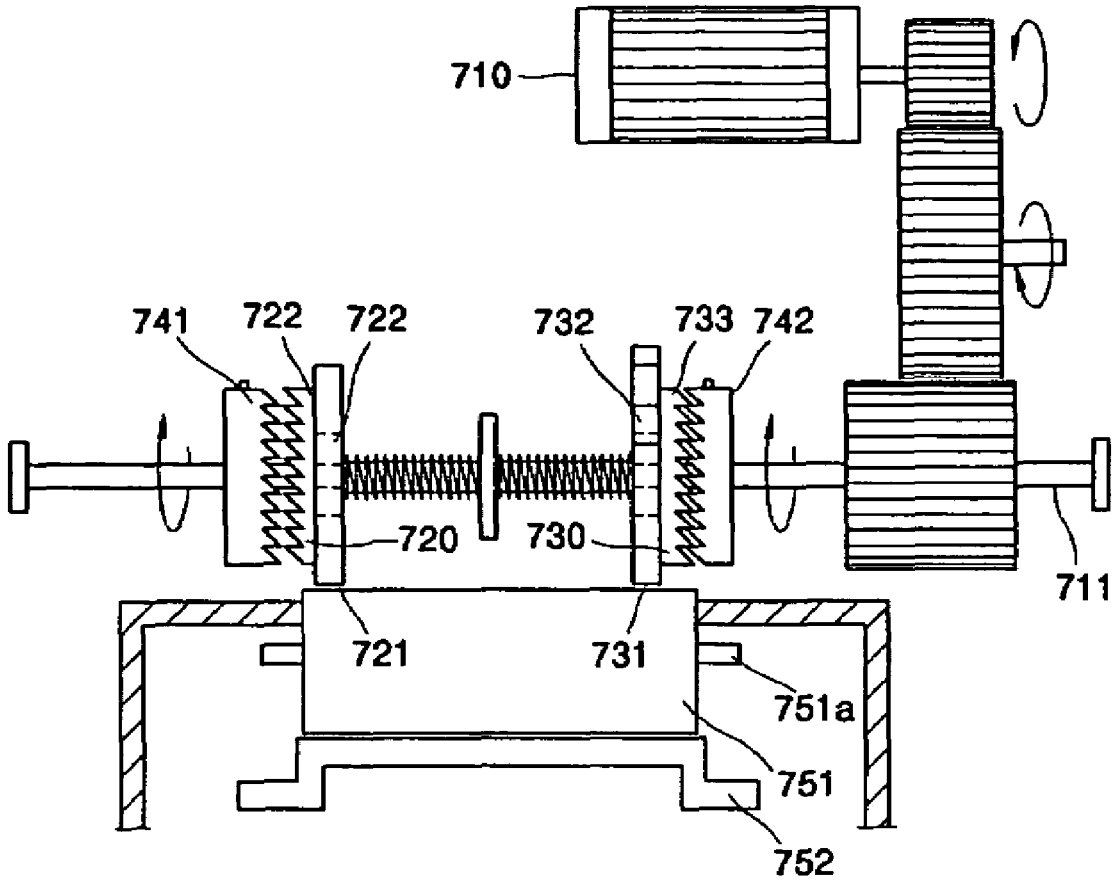

FIGS. 8A and 8B illustrate an operation of the pump unit of FIG. 4. To remove the bubbles from the ink contained in the channel of the printhead 100, the valve 800 of the ink circulation line 600 is opened and the pumping unit 700 is operated in a circulation mode to circulate the ink from the channel to the ink tank 500 and then back to the channel. To circulate the ink in the circulation mode, the motor 710 of the pumping unit 700 rotates the driving shaft counterclockwise as illustrated in FIG. 8A, and thus the first ratchet wheel 741 engages with the ratchet surface 722 of the circulation cam 720 to rotate the circulation cam 720. In a case where the driving shaft is rotated counterclockwise, the second ratchet wheel 742 does not engage with the ratchet surface 733 of the purging cam 730 since the corresponding ratchets slip. Thus, only the inner rim of the bearing 732 rotates and the body of the bearing 732 does not rotate. Although the purging cam 730 may be slightly rotated while the second ratchet wheel 742 and the ratchet surface 733 slip, this rotation is negligible since the power of the motor 710 is not effectively transmitted through the slight rotation. Further, though the protruded portion 730' (see FIG. 7C) of the purging cam 730 may press the piston 751 when the purging cam 730 is slightly rotated, the purging cam 730 cannot maintain a position to allow the protruded portion 730' to continuously press the piston 751 since the piston 751 is elastically supported by an elastic plate 751*a* in an upward direction. Thus, the protruded portion 730' is returned back or does not have enough power transmitted thereto to translate the piston 751 when the driving shaft is rotated counterclockwise. When the circulation cam 720 is rotated by the motor 710 in this state, the piston 751 is vibrated by the gently profiled cam surface 721 of the circulation cam 720, and the elastic diaphragm 752 is repeatedly deformed and returned to its original shape in direct response to the vibration of the piston 751, such that the ink can be sucked through the intake 750*a* and pushed to the outside through the outlet 750*b* as if the ink is sucked and dropped by a dropper. Therefore, by the driving force of the pumping unit 700, the ink can be circulated between the channel of the printhead 100 and the ink tank 500. In addition, the bubbles can float on the ink in the ink tank 500 owing to the specific gravity different between the bubbles and the ink, so that the bubbles can be removed from the ink.

When the bubble removing apparatus operates in a purging mode to remove the bubbles from the ink contained in the chips 110 of the printhead 100, the valve 800 of the ink circulation line 600 is closed and the motor 710 is rotated in an opposite direction to rotate the driving shaft 711 clockwise as illustrated in FIG. 8B. Then, the second ratchet wheel 742 engages the ratchet surface 733 of the purging cam 730 to rotate the purging cam 730. In a case where the motor 710 is rotated in the clockwise direction, the circulation cam 720 is not rotated since the first ratchet wheel 741 and the ratchet surface 722 of the circulation cam 720 slip with each other. Accordingly, the piston 751 is vibrated by the steeply profiled cam surface 731, and this vibration is converted into the large pressure through the elastic diaphragm 752 and transmitted to the chips 110, so that the bubbles in the chips 110 are discharged to the outside of the nozzles 111 together with a little amount of the ink. Therefore, the bubbles can be clearly removed from the chips 110 and the possibility of clogging the nozzles can be eliminated.

As described above, in a bubble removing apparatus, proper pressures for a circulation mode and a purging mode can be obtained by changing a rotation direction of a motor, so that operations required to remove the bubbles can be smoothly performed. The pressure of the purging mode is higher than that of the circulation mode since an eccentric radius of the circulation cam 720 is smaller than a radius of the protruded portion 730' of the purging cam 730.

As described above, although a bubble removing apparatus is configured so that a purging mode is performed when a driving shaft is rotated in a clockwise direction and a circulation mode is performed when the driving shaft is rotated in a counterclockwise direction, the bubble removing apparatus can be configured in a reverse manner by changing a ratchet engagement direction.

As described above, a circulation mode and a purging mode are performed using a single motor to remove bubbles from a printhead channel and from printhead chips, so that a bubble removing apparatus can have a simple structure and a light weight.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A bubble removing apparatus usable in an inkjet printer, comprising:

an ink circulation line to connect an ink tank and a printhead; and a pumping unit to apply a pressure to the ink circulation line to remove bubbles from a channel and a chip of the printhead, wherein the pumping unit comprises:

a housing including an inlet and an outlet that are connected to the ink circulation line;

a vibration unit installed to the housing and capable of vibrating, the vibration unit to generate pressure variations to move ink from the intake to the outlet;

a motor to drive the vibration unit;

a circulation cam to vibrate the vibration unit while rotated by the motor in a circulation mode, to circulate the ink contained in the channel of the printhead along the ink circulation line;

a purging cam installed coaxially with the circulation cam, the purging cam to vibrate the vibration unit while rotated by the motor in a purge mode, to discharge the ink contained in the chip of the printhead through a nozzle; and a clutch unit to transmit power of the motor to one of the circulation cam and the purging cam in a selective manner.

2. The bubble removing apparatus of claim 1, wherein:

the circulation cam comprises a cam surface to cause the vibration unit to vibrate in a gentle manner; and the purging cam comprises a cam surface to cause the vibration unit to vibrate in an abrupt manner.

3. The bubble removing apparatus of claim 1, wherein the clutch unit comprises:

a first ratchet wheel having a first tooth orientation to engage a first ratchet surface formed on the circulation cam to transmit a driving force in one direction;

a second ratchet wheel having a second tooth orientation opposite to the first tooth orientation of the first ratchet wheel, to engage a second ratchet surface formed on the purging cam to transmit the driving force in a direction opposite to the one direction;

a first elastic member to apply a first elastic force in a first direction to allow the first ratchet wheel to engage the ratchet surface of the circulation cam; and a second elastic member to apply a second elastic force in a second direction to allow the second ratchet wheel to engage the ratchet surface of the purging cam.

4. The bubble removing apparatus of claim 3, wherein the first ratchet wheel, the second ratchet wheel, the circulation cam, and the purging cam are coaxially installed on a driving shaft.

5. The bubble removing apparatus of claim 1, wherein the vibration unit comprises:

a piston installed to the housing and capable of reciprocating, the piston being vibrated according to the cam surface of the rotating circulation cam or the cam surface of the rotating purging cam; and an elastic diaphragm to repeatedly deform and return to an original shape thereof to interlock with the piston to generate pressure variations in the housing to suck the ink through the intake and to discharge the ink through the outlet.

6. An apparatus to remove bubbles in an inkjet printer, comprising:

a housing having an inlet, an outlet, and a vibration unit connected between the inlet and the outlet;

a circulation cam having a first shape to control the vibration unit in a circulation mode;

a purging cam having a second shape to control the vibration unit to move ink between the inlet and the outlet in a purging mode; and a single motor to selectively control one of the circulating cam and the purging cam.

7. The apparatus of claim 6, further comprising:

a shaft to receive a rotation power from the single motor, wherein the circulation cam and the purging cam are eccentrically connected to the shaft.

8. The apparatus of claim 6, further comprising:

a shaft spaced apart from the vibration unit and connected to the single motor, wherein the circulation cam and the purging cam are coaxially connected to the shaft to contact the vibration unit according the first shape and the second shape, respectively.

9. The apparatus of claim 6, further comprising:

a shaft connected to the single motor;

a clutch unit connected to the shaft to switch a rotation power of the single motor to one of the circulation cam and the purging cam.

10. The apparatus of claim 9, wherein the clutch comprises a first clutch and a second clutch fixedly connected to the shaft to selectively rotate the circulation cam and the purging cam according to a rotation direction of the shaft.

11. The apparatus of claim 10, wherein the first clutch and the circulation cam comprise a first directional gear and the second clutch and the purging cam comprise a second directional gear.

12. The apparatus of claim 6, wherein the first shape of the circulation cam controls the vibration unit to generate a first pressure between the inlet and the outlet, and the second shape of the purging cam controls the vibration unit to generate a second pressure higher than the first pressure between the inlet and the outlet.

13. An inkjet printer, comprising:

feed rollers to feed the printing medium to the inkjet printhead;

ejecting rollers to remove the printing medium after an image has been formed thereon;

an inkjet printhead to form images on a printing medium;

an ink tank to supply ink to the inkjet printhead; and a pump to circulate the ink from the ink tank to the inkjet printhead, the pump comprising:

a housing having an inlet, an outlet, and a vibration unit connected between the inlet and the outlet, a circulation cam having a first shape to control the vibration unit in a circulation mode, a purging cam having a second shape to control the vibration unit to move ink between the inlet and the outlet in a purging mode, and a single motor to selectively control one of the circulating cam and the purging cam.

14. The inkjet printer of claim 13, wherein the pump further comprises:

ink circulation lines to connect the inlet and the outlet to the inkjet printhead; and a valve provided on one of the ink circulation lines to stop circulating ink when in pump is in the purging mode.

15. The inkjet printer of claim 13, the pump further comprising:

a shaft connected to the single motor;

a clutch unit connected to the shaft to switch a rotation power of the single motor to one of the circulation cam and the purging cam.

* * * * *